US011701706B2

(12) United States Patent
Sakuramoto et al.

(10) Patent No.: US 11,701,706 B2
(45) Date of Patent: Jul. 18, 2023

(54) FINE COPPER PARTICLES, METHOD FOR PRODUCING FINE COPPER PARTICLES AND METHOD FOR PRODUCING SINTERED BODY

(71) Applicant: TAIYO NIPPON SANSO CORPORATION, Tokyo (JP)

(72) Inventors: Yuji Sakuramoto, Kawasaki (JP); Hiroshi Igarashi, Kai (JP); Takayuki Fujimoto, Kawasaki (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 0 days.

(21) Appl. No.: 17/572,402

(22) Filed: Jan. 10, 2022

(65) Prior Publication Data

US 2022/0126362 A1 Apr. 28, 2022

Related U.S. Application Data

(62) Division of application No. 16/493,800, filed as application No. PCT/JP2018/008768 on Mar. 7, 2018, now abandoned.

(30) Foreign Application Priority Data

Mar. 24, 2017 (JP) ..... 2017-058593

(51) Int. Cl.
*B22F 3/10* (2006.01)
*B22F 1/145* (2022.01)
(Continued)

(52) U.S. Cl.
CPC ..... *B22F 3/1007* (2013.01); *B22F 1/054* (2022.01); *B22F 1/145* (2022.01); *B22F 1/16* (2022.01);
(Continued)

(58) Field of Classification Search
None
See application file for complete search history.

(56) References Cited

U.S. PATENT DOCUMENTS 2,252,714 A * 8/1941 Hall ..... B22F 9/22 432/13
2010/0147110 A1* 6/2010 Igarashi ..... B22F 9/28 75/369
(Continued)

FOREIGN PATENT DOCUMENTS

CN 103182504 7/2013
JP 2002-356702 12/2002
(Continued)

OTHER PUBLICATIONS

Oh et al., "Effect of copper oxide shell thickness on flash light sintering of copper nanoparticle ink", RSC Adv., 2017, 7, 17724-17731. Published Mar. 22, 2017. (Year: 2017) (8 pages).
(Continued)

*Primary Examiner* — Paul A Wartalowicz
*Assistant Examiner* — Stephani Hill
(74) *Attorney, Agent, or Firm* — Nixon & Vanderhye P.C.

(57) ABSTRACT

A method for producing fine copper particles includes producing fine copper particles having a coating film containing cuprous oxide on a surface by heating copper or a copper compound in a reducing flame formed by a burner. The fine copper particles are produced by adjusting a mixing ratio between a combustible gas and a combustion supporting gas which form the reducing flame such that a volume ratio of $CO/CO_2$ is in a range of 1.5 to 2.4.

2 Claims, 5 Drawing Sheets

(51) Int. Cl.

| | |
|---|---|
| ***B22F 9/22*** | (2006.01) |
| ***B22F 1/16*** | (2022.01) |
| ***B22F 1/054*** | (2022.01) |

(52) U.S. Cl.

CPC ..... *B22F 9/22* (2013.01); *B22F 1/056* (2022.01); *B22F 2201/01* (2013.01); *B22F 2201/013* (2013.01); *B22F 2201/04* (2013.01); *B22F 2301/10* (2013.01); *B22F 2302/25* (2013.01); *B22F 2304/054* (2013.01); *B22F 2304/056* (2013.01); *B22F 2304/058* (2013.01)

(56) References Cited

U.S. PATENT DOCUMENTS

| | | | | |
|---|---|---|---|---|
| 2013/0164553 | A1* | 6/2013 | Lee | H01B 1/026 428/570 |
| 2019/0375022 | A1* | 12/2019 | Sakuramoto | B22F 1/142 |
| 2020/0070244 | A1 | 3/2020 | Sakuramoto et al. | |
| 2020/0376546 | A1* | 12/2020 | Yonezawa | C09D 11/322 |

FOREIGN PATENT DOCUMENTS

| | | | |
|---|---|---|---|
| JP | 2005-154861 | | 6/2005 |
| JP | 2008-146991 | A | 6/2008 |
| JP | 2012-207250 | A | 10/2012 |
| JP | 2012-214641 | A | 11/2012 |
| JP | 2013-136840 | | 7/2013 |
| JP | 2014-156634 | | 8/2014 |
| JP | 2016-028176 | | 2/2016 |
| JP | 5873471 | | 3/2016 |
| JP | 2017-2364 | | 1/2017 |
| JP | 6130616 | | 5/2017 |
| TW | I530456 | B | 4/2016 |
| WO | 2006/068231 | | 6/2006 |

OTHER PUBLICATIONS

International Search Report for PCT/JP2018/008768, dated Apr. 3, 2018, 4 pages.

Search Report issued in EP Appln. No. 18771581.8 dated Oct. 8, 2020.

Chatterjee et al., "Optical absorption in composites containing copper core-copper-oxide shell nanostructure in a silica gel" *J. Phys. D: Appl. Phys.*, vol. 38: 451-455 (2005).

Schöβ et al., "Oxidation of copper at high temperature as an example for gas-solid reactions in a downer reactor—experiments and model-based analysis" *Chemical Engineering Science*, vol. 151: 116-129 (2016).

Notice of Allowance issued in JP Appln. No. 2017-058593 dated Nov. 4, 2020 (w/ translation).

Office Action dated Jul. 27, 2021 issued in Chinese Application No. 201880019298.7 with English translation (19 pages).

Restriction Requirement dated Jun. 24, 2021 issued in related U.S. Appl. No. 16/493,800 (9 pages).

Tokozakura et al., "Transmission electron microscopy observation of oxide layer growth on Cu nanoparticles and formation process of hollow oxide particles" J. Mater. Res., vol. 22, No. 10, Oct. 2007, 2930-2935. (Year: 2007).

Office Action dated Oct. 12, 2021 issued in related U.S. Appl. No. 16/493,800 (20 pages).

Notice of Allowance dated May 10, 2023 issued in Taiwanese Application No. 107108672 with partial English translation (6 pages).

* cited by examiner

FINE COPPER PARTICLES, METHOD FOR PRODUCING FINE COPPER PARTICLES AND METHOD FOR PRODUCING SINTERED BODY

This application is a divisional application of U.S. application Ser. No. 16/493,800, filed Sep. 13, 2019, which is the U.S. national phase of International Application No. PCT/JP2018/008768 filed 7 Mar. 2018, which designated the U.S. and claims priority to JP Patent Application No. 2017-058593 filed 24 Mar. 2017, the entire contents of each of which are hereby incorporated by reference.

FIELD OF THE INVENTION

The present invention relates to fine copper particles, a method for producing fine copper particles, and a method for producing a sintered body.

DESCRIPTION OF RELATED ART

In recent years, for example, technological innovations such as high-density wiring have become remarkable with the increase in performance, miniaturization, and weight reduction of electronic devices and printed wiring boards used in electronic component devices. Examples of a material for forming such a high-density wiring include a conductive ink and a conductive paste. These materials contain fine silver particles in order to impart conductivity. However, silver has problems such as high cost and easy migration. For this reason, it is considered to use fine copper particles which are low in cost and have the same conductivity as that of silver instead of silver fine particles.

On the other hand, metal fine particles have a problem that they tend to deteriorate due to oxidation when left in the atmosphere. In order to prevent such deterioration of metal fine particles due to oxidation, for example, it is conceivable to coat the surface of the fine particles with an antioxidant or the like.

However, the thicker the coating, such as an antioxidant, coated to the surface of the fine particles, the higher the sintering temperature is required to sinter the fine particles while reliably removing the coating.

Thus, when the sintering temperature of the metal fine particles increases, for example, when a conductive ink or a conductive paste containing the metal fine particles is used in a printed wiring board or the like having a resin substrate, a resin material having low heat resistance such as a PET film or the like cannot be used.

For this reason, when using a conductive ink or a conductive paste containing metal fine particles, it is necessary to use a material having high heat resistance such as polyimide for the resin substrate, which causes a cost increase.

For this reason, there is a demand for fine particles which can be used in a resin substrate made of a material having low heat resistance such as a PET film and sintered at low temperatures as fine particles contained in a conductive ink and a conductive paste.

In order to solve the problems when the surface of the metal fine particles is coated with an antioxidant or the like as described above, a technique for coating the surface of the fine particles with an oxide has been proposed. For example, Patent Document 1 below discloses fine copper particles of which the surface is coated with copper oxide using copper as a raw material, and a method for producing fine copper particles.

PRIOR ART DOCUMENTS

Patent Literature

Patent Document 1: Japanese Unexamined Patent Application, First Publication No. 2016-028176

DISCLOSURE OF THE INVENTION

Problem to be Solved by the Invention

However, as a result of intensive studies by the present inventors, it was revealed that the fine copper particles disclosed in Patent Document 1 exhibit high conductivity when simply pressed, so the coating layer containing copper oxide could not completely cover the surface of the fine copper particles. In such a case, deterioration of the fine copper particles due to oxidation proceeds. For this reason, after all, there was a problem which it was necessary to separately coat the surface of the fine copper particles with an antioxidant or the like.

The present invention has been made in view of the problems above, and an object of the present invention is to provide fine copper particles which are less likely to be deteriorated by oxidation in the atmosphere without being coated with an antioxidant or the like and can be sintered at a lower temperature, a method for producing fine copper particles, and a method for producing a sintered body.

Means to Solve the Problem

In order to solve the problems above, the present invention includes the following aspects.

The present invention provides fine copper particles wherein an entire surface is covered with a coating film containing cuprous oxide and having an average film thickness of 1.5 nm or less.

According to the present invention, since the entire surface of the fine copper particles is covered with the coating film containing cuprous oxide and having the average film thickness above, it is possible to effectively suppress the deterioration due to oxidation in the atmosphere. In addition, since the reduction of the coating film is facilitated during sintering, the sintering temperature can be lowered.

The fine copper particles of the present invention preferably have an average particle diameter of 500 nm or less. According to the present invention, the coating film is more easily reduced during sintering, and the coating film is easily removed by adjusting the average particle size to 500 nm or less, so the sinterability is further improved.

Further, the present invention provides a method for producing fine copper particles in which fine copper particles having a coating film containing cuprous oxide on a surface are produced by heating copper or a copper compound in a reducing flame formed by a burner wherein the fine copper particles are produced by adjusting a mixing ratio between a combustible gas and a combustion supporting gas which form the reducing flame such that a volume ratio of $CO/CO_2$ is in a range of 1.5 to 2.4.

According to the present invention, the coating film containing cuprous oxide can be formed on the entire surface of the fine copper particles while adjusting the average film thickness to 1.5 nm or less by adjusting the mixing ratio between the combustible gas and the combustion supporting gas which are supplied to the burner. For this reason, the progress of the oxidation in the atmosphere is suppressed and the deterioration becomes difficult. Further, it is possible to produce fine copper particles having a sintering temperature lower than that of prior art by producing fine copper particles such that the coating film containing cuprous oxide has the average film thickness above.

The present invention also provides a method for producing a sintered body wherein the fine copper particles are used as a raw material and sintered them in a reducing atmosphere at 150° C. or lower.

The production method of the present invention is a method of using the fine copper particles with the coating film containing cuprous oxide and having an average film thickness of 1.5 nm or less on the entire raw material, and sintering the fine copper particles. As a result, even when the sintering temperature is as low as 150° C., the coating film is easily reduced and removed during sintering, and a sintered body can be produced with excellent sinterability.

In the present description, "sintering in a reducing atmosphere at 150° C. or lower" refers to a state in which the fine copper particles are sufficiently sintered in a reducing atmosphere at 150° C. or lower within 1 hour.

Effects of the Invention

According to the fine copper particles of the present invention, since the entire surface is covered with the coating film containing cuprous oxide film and an average film thickness of 1.5 nm or less, even when stored in the air, it is possible to effectively suppress the deterioration due to oxidation. In addition, when fine copper particles are sintered, the coating film containing cuprous oxide is easily reduced, so the sintering temperature can be lowered. Therefore, for example, since the fine copper particles can be used in high-density wiring on the surface of a resin substrate having low heat resistance, it is possible to reduce the cost of electronic devices, printed wiring boards, and the like.

In addition, according to the method for producing fine copper particles of the present invention, a coating film can be formed on the entire surface of the fine copper particles while adjusting the coating film containing cuprous oxide to 1.5 nm or less by adjusting the mixing ratio between the combustible gas and the combustion supporting gas which are supplied to the burner. Accordingly, oxidation is prevented from proceeding in the atmosphere, and is difficult to deteriorate in the fine copper particles produced by the production method according to the present invention. Further, it is possible to produce the fine copper particles having a sintering temperature lower than that of prior art by producing fine copper particles such that the coating film containing cuprous oxide has the average film thickness above.

Moreover, the method for producing a sintered body according to the present invention is a method for using the fine copper particles according to the present invention having a low sintering temperature as a raw material and sintering them in a reducing atmosphere of 150° C. or lower. Accordingly, for example, the sintered body produced by the production method according to the present invention can be easily used in high-density wiring or the like on the surface of a resin substrate having low heat resistance, and the cost of electronic devices, printed wiring boards, and the like can be reduced.

DETAILED DESCRIPTION OF THE INVENTION

Figure 1:
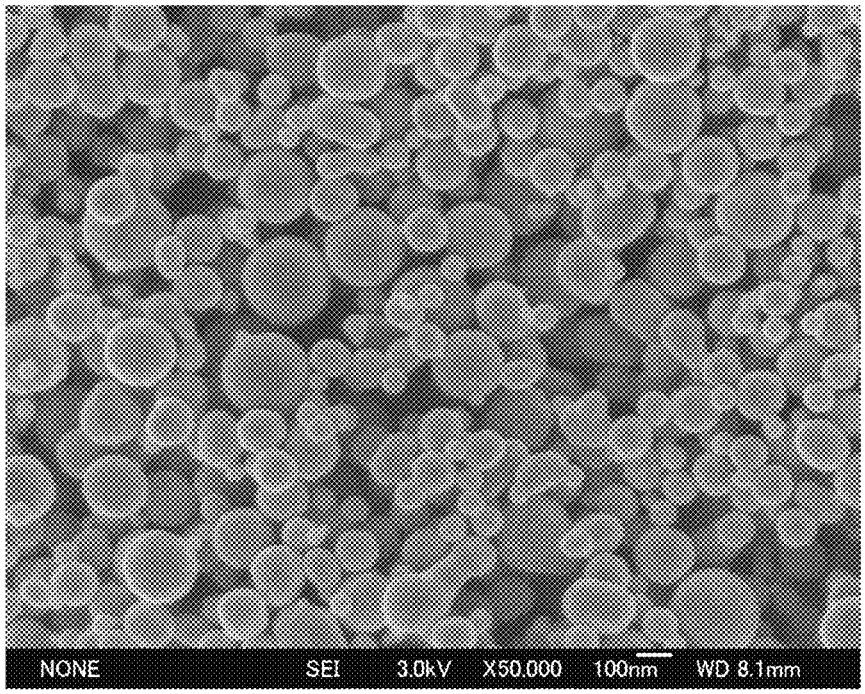
FIG. 1 is a figure for explaining the fine copper particles which are one embodiment of the present invention, and is a photograph of the fine copper particles by a scanning electron microscope (SEM).

Hereinafter, fine copper particles, a production method for fine copper particles, and a production method for a sintered body of one embodiment according to the present invention will be described with reference to FIGS. 1 to 7 as appropriate. Moreover, in order to make the features easy to understand, there are cases where the structure which become the features are enlarged for the sake of convenience, and the dimensional ratios of the respective structures are not always the same as the actual ones in the drawings used in the following description. In addition, the materials and the like exemplified in the following description are mere examples, and the present invention is not limited to them, and can be appropriately modified and implemented without changing the gist thereof.

<Fine Copper Particles>

The fine copper particles of the present embodiment are, for example, fine particles of a submicron scale or less, wherein the entire surface is covered with a coating film containing cuprous oxide and having an average film thickness of 1.5 nm or less as shown in an observation photograph by a scanning electron microscope (SEM) in FIG. 1.

In general, the surface of the fine copper particles is oxidized to produce the coating film containing cuprous oxide. Usually, the coating film produced has a non-uniform formation position and a non-uniform thickness on the surface of the fine copper particles, and at least a part of the surface of the fine copper particles is exposed.

In contrast, the fine copper particles of the present embodiment are covered with the coating film containing cuprous oxide on the entire surface as described above. In particular, since the coating film having the upper limit of the average film thickness being formed without gaps, it is possible to effectively suppress the deterioration due to oxidation in the atmosphere. In addition, since the coating film is easily reduced during sintering, the sintering temperature can be further reduced.

As described above, the fine copper particles of the present embodiment have an average film thickness of 1.5 nm or less, more preferably 1.3 nm or less, formed on the entire surface. By setting the upper limit of the average film thickness of the coating film containing cuprous oxide formed on the surface of fine copper particles to 1.5 nm, while suppressing the progress of the deterioration in the atmosphere, the coating film can be easily reduced during sintering, so the effect of lowering the sintering temperature can be reliably obtained.

In addition, the lower limit of the average film thickness of the coating film containing cuprous oxide is not particularly limited. However, since it is difficult for industrial production to form the coating film having an average film thickness of less than 0.3 nm on the surface of fine copper particles without gaps, the lower limit is set to less than 0.3 nm.

The "average film thickness of the coating film" described in the present embodiment can be obtained by, for example, measuring the mass oxygen concentration of the fine copper particles and converting the oxygen concentration and the average particle diameter of the fine copper particles.

The film thickness of the coating film formed on the surface of the fine copper particles will be described in detail in the explanation of the production method described later. The film thickness can be controlled to a desired range by adjusting the volume ratio of $CO/CO_2$ in the combustion exhaust gas generated by the combustion of the burner within the optimum range.

The particle diameter of the fine copper particles of the present embodiment is preferably 5 nm or more and 1000 nm or less.

Further, the fine copper particles may have a uniform particle diameter in the range above in the present embodiment. However, the particle diameter may be distributed around the average particle diameter, and the average particle diameter in this case is preferably 500 nm or less. Thus, when the average particle diameter is 500 nm or less, the coating film is more easily reduced during sintering, and the coating film can be easily removed, so the sinterability is further improved. When the average particle diameter of the fine copper particles exceeds 500 nm, the total particle size becomes too large and the total amount of the coating film in each particle unit increases, so the coating film is difficult to reduce during sintering and the sintering temperature rises. In addition, the sinterability may be decreased.

The average particle diameter of the fine copper particles is more preferably in the range of 50 to 150 nm.

The average particle diameter of the fine copper particles described in the present embodiment is a particle diameter which is obtained by measuring a specific surface area per unit mass of the fine copper particles using a specific surface area meter (for example, Macsorb HM model-1201 etc., manufactured by Mountec Co., Ltd.), and converting based on the obtained specific surface area.

When the specific surface area per unit mass is S ($m^2/g$) and the density is ρ ($g/cm^3$), the average particle diameter Dave (nm) can be obtained from the following equation.

$$Dave=6000/(\rho \times S)$$

Further, the detailed composition of the fine copper particles of the present embodiment is not particularly limited as long as the fine copper particles contain copper (Cu), but the copper element is preferably 95% by mass, and more preferably 97% by mass or more with respect to the entire fine particles.

<Method for Producing Fine Copper Particles>

The production method for fine copper particles of the present embodiment is a method for producing fine copper particles having a coating film containing cuprous oxide on the surface by heating copper or a copper compound in a reducing flame formed by a burner. In the production method of the present embodiment, the fine copper particles are produced by adjusting a mixing ratio between the combustible gas and the combustion supporting gas such that the volume ratio of $CO/CO_2$ in the combustion exhaust gas is in the range of 1.5 to 2.4

The producing apparatus used in the production method for fine copper particles of this embodiment and the producing procedure in the method for producing fine copper particles will be described in detail below.

[Producing Apparatus for Fine Copper Particles]

One example of a producing apparatus used in the production method for fine copper particles of this embodiment will be described in detail below.

Figure 2:
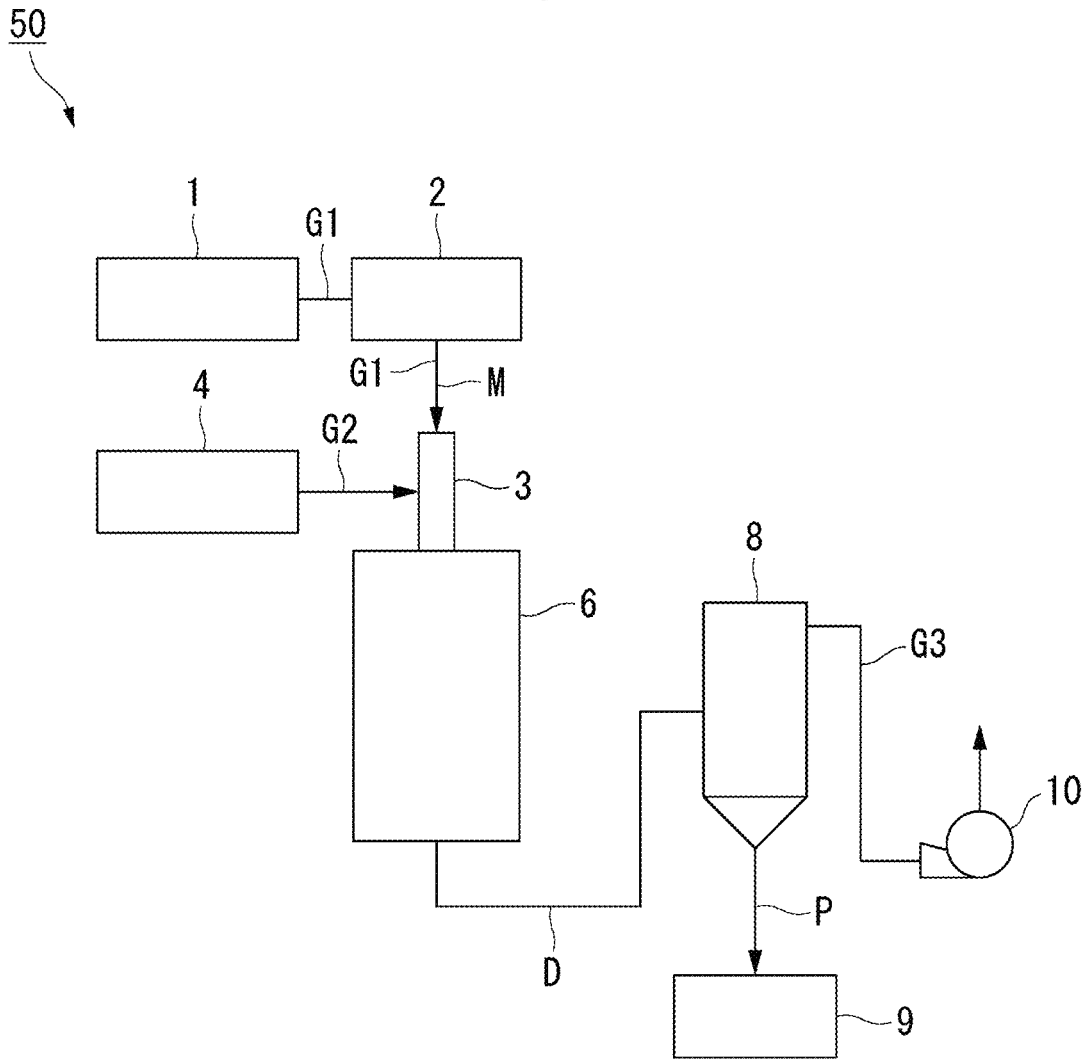
FIG. 2 is a figure for schematically illustrating the method for producing fine copper particles which is one embodiment of the present invention, and is a schematic block diagram for showing an example of the producing apparatus used in producing the fine copper particles.

The producing apparatus 50 shown in FIG. 2 is schematically configured to include a burner 3 which is configured to form a high-temperature flame and a reaction furnace 6 which is configured to produce fine copper particles P inside. Further, the producing apparatus 50 shown in FIG. 1 further includes a combustible gas supply unit 1 which is configured to supply a combustible gas G1, a feeder 2 which is configured to supply a raw material to the burner 3 using the combustible gas G1 supplied from the combustible gas supply unit 1 as a carrier gas, a combustion supporting gas supply unit 4 which is configured to supply a combustion supporting gas G2 to the burner 3, a bug filter 8 which is configured to separate gas (a combustion exhaust gas G3) and powder (the fine copper particles P) generated inside the reaction furnace 6, a collection unit 9 which is configured to collect the fine copper particles P separated by the bug filter 8, and a blower 10 which is configured to suck the combustion exhaust gas G3.

The combustible gas supply unit 1 stores the combustible gas G1 for forming a high-temperature flame, and transfers the combustible gas G1 toward the feeder 2. Although detailed illustration is abbreviated in figures, the combustible gas supply unit 1 has a structure which can adjust the supply amount of the combustible gas G1. For example, the combustible gas supply unit 1 is provided with a container which stores the combustible gas G1, a flow regulator, and the like.

In the present embodiment, for example, methane, propane, hydrogen, or a mixed gas of methane and hydrogen can be selected and used as the combustible gas G1.

The feeder 2 quantitatively transfers the combustible gas G1 as a carrier gas (transferring gas) and the powder raw material M as a raw material of the fine copper particles P toward the burner 3.

Since the production method in this embodiment is a method for producing fine copper particles P, copper or a copper compound is used as the powder raw material M supplied from the feeder 2.

The burner 3 is provided to the upper part of the reaction furnace 6 to be described later, and the powder raw material M is supplied into the reaction furnace 6 while ejecting the combustible gas G1 into the reaction furnace 6, and forming a high temperature reducing flame in the reaction furnace 6.

Figure 3:
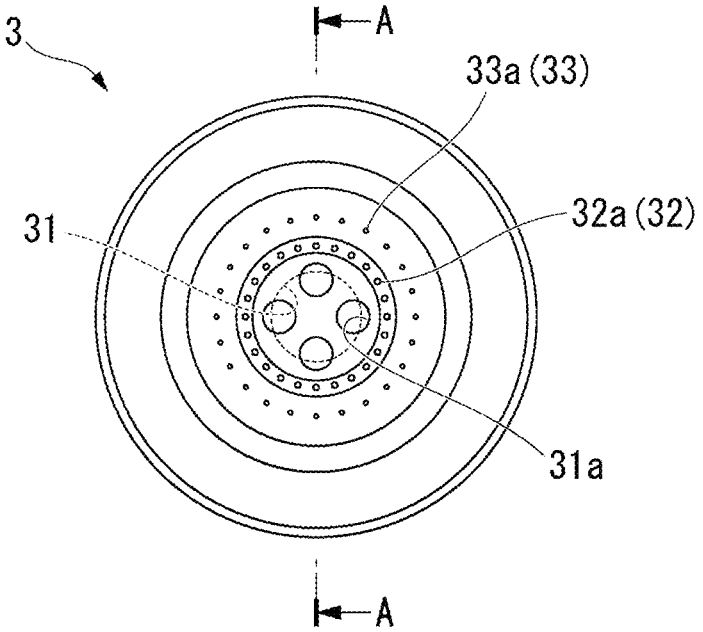
FIG. 3 is a figure for schematically illustrating the method for producing fine copper particles which is one embodiment of the present invention, and is a planner view for showing one example of a burner provided with the producing apparatus of the fine copper particles shown in FIG. 2.
Figure 4:
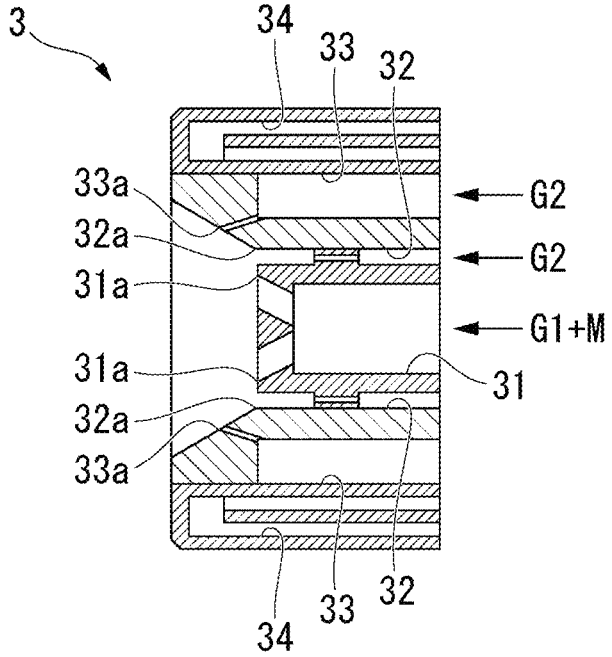
FIG. 4 is a figure for schematically illustrating the method for producing fine copper particles which is one embodiment of the present invention, and is a cross-sectional view taken along the line A-A of the burner shown in FIG. 3.

The burner 3 shown in FIGS. 3 and 4 is provided with a raw material ejection passage 31 which is configured to eject the powder raw material M as a raw material for the fine copper particles P and the combustible gas G1 along the central axis. In addition, a primary combustion supporting gas ejection passage 32 which is configured to eject the combustion supporting gas G2 is provided in parallel to the central axis of the raw material ejection passage 31 on the outer peripheral side of the raw material ejection passage 31. Further, a secondary combustion supporting gas ejection passage 33 which is configured to eject the combustion supporting gas G2 toward one point on the extension line of the central axis of the burner 3 is coaxially provided on the outer peripheral side of the primary combustion supporting gas ejection passage 32. Further, a water cooling jacket 34 is provided on the outer peripheral side of the secondary oxygen supply passage 33 so that the burner 3 itself can be cooled with water.

Moreover, as shown in FIG. 3, the elliptical openings 31*a*, which are the tip ends of the raw material ejection passage 31, are provided at four locations, equally arranged on the circumference.

Further, a plurality of small-diameter openings 32*a*, which are the tip ends of the primary combustion supporting gas ejection passage 32, are provided so as to be evenly arranged on the circumference.

Further, a plurality of small-diameter openings 33*a*, which are the tip ends of the secondary oxygen supply passage 33, are provided evenly arranged on the circumference.

That is, the openings 31*a* of the raw material ejection passage 31, the openings 32*a* of the primary combustion supporting gas ejection passage 32, and the opening 33*a* of the secondary combustion supporting gas ejection passage 33 are arranged concentrically along the central axis of the burner 3, respectively.

As shown in FIG. 4, the plurality of openings 31*a* which are the tip ends of the raw material ejection passage 31 are inclined with respect to the central axis of the burner 3 in a range of 5° to 45° so that the central axis of the raw material ejection passage 31 is inclined toward the outer diameter side of the burner 3 toward the tip end of the burner 3.

Further, the plurality of openings 32*a* which are the tip ends of the primary combustion supporting gas ejection passage 32 are provided so as to eject the combustion supporting gas G2 in parallel to the central axis of the burner 3.

In addition, the plurality of openings 33*a* which are tip ends of the secondary combustion supporting gas ejection passage 33 are provided such that the central axis of each of the openings 33*a* is inclined with respect to the central axis of the burner 3 in a range of approximately 5 to 45 degrees so as to reach one point on the extension line of the central axis of burner 3.

Since the burner 3 is configured as described above, the combustible gas G1 and the powder raw material M from the feeder 2 are transferred into the raw material ejection passage 31. In addition, the combustion supporting gas G2 such as air, oxygen-enriched air, or oxygen is transferred into the primary combustion supporting gas ejection passage 32 and the secondary oxygen supply passage 33 from the combustion supporting gas supply unit 4 which will be described later with the flow rate adjusted individually.

As the material of the burner 3, for example, a stainless material such as SUS316 can be used. However, the material is not limited to this, and any material can be used as long as it is durable to high temperatures.

The structure of the burner 3 is not limited to that shown in FIGS. 3 and 4, and the nozzle arrangement, and the arrangement, shape, angle, and number of the openings can be appropriately adjusted.

The combustion supporting gas supply unit 4 supplies the combustion supporting gas G2 for stably forming a high-temperature flame to the burner 3. As the combustion supporting gas G2, air, oxygen-enriched air, oxygen, or the like is used as described above. Although not shown in detail in figures, the combustion supporting gas supply unit 4 of the present embodiment can adjust the flow rate or the like of the combustion supporting gas G2 so that the ratio of the combustible gas G1 and the combustion supporting gas G2 in the burner 3 can be adjusted.

The high-temperature reducing flame formed by the burner 3 is taken into the reaction furnace 6, and the copper or the copper compound transferred by the combustible gas G1 evaporates in the reducing flame. Thereby, the fine copper particles P of a submicron scale or less are produced. As described above, the burner 3 is provided to the upper portion of the reaction furnace 6 so that the front end portion (flame formation side) of the burner 3 faces downward.

Moreover, although detailed illustration is abbreviated in figures, the reaction furnace 6 can cool internal combustion gas by circulating a cooling water to the water cooling jacket with which a surrounding wall part is equipped, and can block the atmosphere in the reaction furnace from the outside of the reaction furnace.

Although the reaction furnace 6 may be a metal furnace, it may be a furnace using a refractory wall. In this case, the combustion gas in the reaction furnace can be cooled by taking the first cooling gas G3 such as nitrogen or argon into the reaction furnace using a gas supply device such as a first cooling gas supply unit that will be described later. Furthermore, the reaction furnace 6 can be configured by a combination of a water-cooled wall and a refractory wall.

Although the detailed illustration is abbreviated in figures, the reaction furnace 6 may be configured such that, for example, a cooling gas such as nitrogen or argon is taken into the reaction furnace and a swirling flow is formed in the reaction furnace. That is, a plurality of gas intake holes (not shown in figures) are formed on the peripheral wall of the reaction furnace 6 in the circumferential direction and the height direction, and the gas ejection direction of these gas intake holes is formed along the inner peripheral surface of the reaction furnace 6. Thereby, when cooling gas is taken into the reaction furnace 6, the swirling flow of combustible gas G1 can be generated in the reaction furnace.

The way how to generate the swirling flow of gas in the reaction furnace 6 is not limited to the one having the configuration above. For example, the swirling flow can be generated by adjusting the position of the burner 3 to the reaction furnace 6, the direction of the nozzle, or the shape and structure of the nozzle opening of the burner 3.

The bug filter 8 catches the fine copper particles P as products by separating the exhaust gas D discharged from the bottom of the reaction furnace 6 into the fine copper particles P and the combustion exhaust gas G3. As the bug filter 8, any one having a configuration conventionally used in this technical field can be employed without any limitations.

The fine copper particles P caught by the bug filter 8 are transferred to the collection unit 9 which is configured to collect and store the fine copper particles P, and the combustion exhaust gas G3 is transferred, for example, to an exhaust gas treatment device (not shown in figures) or the like by an intake action of the blower 10 that will be described later.

In the present embodiment, an embodiment is described in which the exhaust gas D is separated into the fine copper particles P and the combustion exhaust gas G3 using the bug filter 8. However, the present invention is not limited to this embodiment, and it is also possible to employ a cyclone, a dust collector or the like.

As described above, the blower 10 sends (discharges) the combustion exhaust gas G3 separated by the bug filter 8 toward the outside of the producing apparatus 50. As the blower 10, a general blower including a motor and a fan can be used without any limitations.

[Production of Fine Copper Particles]

A method for producing fine copper particles P using the producing apparatus 50 having the configuration above will be described in detail below.

As described above, the production method of the present embodiment is a method in which copper or the copper compound is heated in the reducing flame formed in the reaction furnace 6 by the burner 3, and the fine copper particles P having the coating film containing cuprous oxide on the surface is produced. In the production method of the present embodiment, the mixing ratio between the combustible gas G1 and the combustion supporting gas G2 is adjusted so that the volume ratio of $CO/CO_2$ in the combustion exhaust gas G3 is in the range of 1.5 to 2.4, and the fine copper particles P are produced.

When producing the fine copper particles P using the producing apparatus 50, first, the powder raw material M is set in the feeder 2, and the combustible gas G is transferred from the feeder 2 into the raw material ejection passage 31 of the burner 3. Thereby, the combustible gas G1 is supplied, while transferring the powder raw material M in the feeder 2. At this time, the powder raw material M is quantitatively transferred from the feeder 2 toward the burner 3 while being transferred to the combustible gas G1. In addition, at the same time, the combustion supporting gas G2 is transferred from the combustion supporting gas supply unit 4 into the primary combustion supporting gas ejection passage 32 and the secondary combustion supporting gas ejection passage 33 of the burner 3, so that the combustible gas G1 and the combustion supporting gas G2 are combusted by the burner 3, and the high-temperature reducing flame is formed in the reactor 6.

At this time, as the combustible gas G1 supplied from the combustible gas supply unit 1, for example, 100% methane gas, 80% methane gas+20% hydrogen gas, 60% methane gas+40% hydrogen gas, or 100% propane gas can be used without any limitations.

The combustible gas G1 is not limited to these gases, and any gas can be used as long as it is a gas capable of forming a reducing flame.

In the present embodiment, the flow rate of the combustible gas G1 is not particularly limited, and may be set so that the gas ratio of the combustion exhaust gas G3 falls within a predetermined range as will be described later.

Further, the combustion supporting gas G2 is not particularly limited. As described above, air, oxygen-enriched air, oxygen (oxygen 100%), or the like can be appropriately used in consideration of a necessary oxygen amount and the like.

In the production method of the present embodiment, the mixing ratio between the combustible gas G1 and the combustion supporting gas G2 is adjusted so that the volume ratio of $CO/CO_2$ in the combustion exhaust gas G3 is in the range of 1.5 to 2.4 described above.

At this time, the mixing ratio is adjusted by adjusting the flow rate of the combustible gas G1 with the combustible gas supply unit 1, the flow rate of the combustion supporting gas G3 with the combustion supporting gas supply unit 4, or the mixing ratio between the combustible gas G1 and the combustion supporting gas G3.

More specifically, for example, it is preferable to control the volume ratio of $CO/CO_2$ in the combustion exhaust gas G3 to be in the range above by adjusting the flow rate of the combustion supporting gas G2, while keeping the composition and flow rate of the combustible gas G1 constant from the viewpoint of ease of control and the like. At this time, it is preferable that the amount of the combustion supporting gas supplied from the combustion supporting gas supply unit 4 to the burner 3, that is, the amount of oxygen, be appropriately adjusted while taking into consideration the amount of oxygen serving as a reducing atmosphere.

In the present embodiment, it is possible to produce the fine copper particles P such that the entire surface of the fine copper particles P is covered with the coating film containing cuprous oxide while suppressing the thickness of the coating film containing cuprous oxide to 1.5 nm or less by adjusting the mixing ratio between the combustible gas G1 and the combustion supporting gas G2 which are supplied to the burner 3 so that the volume ratio of $CO/CO_2$ in the combustion exhaust gas G3 is in the range above. Thereby, the sintering temperature of the fine copper particles P produced can be set to a low temperature of 150° C. or lower. Further, the fine copper particles P produced by such a method are covered with the coating film on the entire surface, so that the oxidation is suppressed from progressing in the atmosphere and hardly deteriorates.

When the volume ratio of $CO/CO_2$ in the combustion exhaust gas G3 is 1.5 or more, the thickness of the coating film formed on the surface of the fine copper particles does not become too large, and the coating film is easily reduced during sintering. Therefore, it can be sintered at a low temperature and has excellent sinterability. On the other hand, when the volume ratio of $CO/CO_2$ in the combustion exhaust gas G3 is 2.4 or less, the thickness of the coating film formed on the surface of the fine copper particles can be reduced. At the same time, even when the ratio of CO in the combustion exhaust gas G3 is high, the fine copper particles produced are easily dispersed in the organic solvent. Thereby, the slurry for producing a sintered body can be adjusted easily, and it becomes a preferable raw material of a sintered body.

As described above, the fine copper particles P having the coating film containing cuprous oxide formed on the surface having an average film thickness of 1.5 nm or less, which are excellent dispersibility in an organic solvent, and suitable for producing a sintered body can be obtained by adjusting the mixing ratio between the combustible gas G1 and the combustion supporting gas G2 so that the volume ratio of $CO/CO_2$ in the combustion exhaust gas G3 is in the range of 1.5 to 2.4.

Moreover, as the powder raw material M supplied from the feeder 2, powder of copper (metal copper) or a copper compound (for example, copper oxide, and the like) is used in this embodiment.

The particle diameter of the powder raw material M is not particularly limited, but considering the preferable average particle diameter range of the fine copper particles produced P, it is preferable to use the powder raw material M having an average particle diameter in the range of 1 to 50 μm.

In addition, the average particle diameter of the powder raw material M demonstrated in this embodiment means the value obtained by conversion from the specific surface area above.

Moreover, as the powder raw material M used in the present embodiment, in addition to the above, for example, any raw materials such as copper nitrate and copper hydroxide which can produce copper oxide by heating and has a high purity can be used without any limitations.

As described above, the copper powder or the copper compound powder introduced into the reducing flame by the burner 3 becomes fine copper particles P having a particle diameter smaller than that of the powder raw material M and smaller than a submicron level by heating, evaporating, and reducing. Further, the coating film containing cuprous oxide and having an average film thickness of 1.5 nm or less is formed on the surface of the fine copper particles P produced at this time.

When producing the fine copper particles P, for example, it is possible to suppress increase in diameter due to the fine copper particles P produced colliding with each other and fuse by passing cooling water through a water cooling jacket (not shown in figures) provided in the reaction furnace 6 to rapidly cool the reaction furnace atmosphere.

Further, it is possible to prevent the fine copper particles P from being combined to increase the diameter by taking the cooling gas (not shown in figures) into the reaction furnace 6, and forming a swirl flow in the reaction furnace, while controlling the shape of the fine copper particles P to be produced into a spherical shape.

The fine copper particles P produced in the reaction furnace 6 are taken out from the bottom of the reaction furnace 6 as the exhaust gas D together with the combustion exhaust gas G3 and introduced into the bug filter 8. Then, the fine copper particles P caught in the bug filter 8 are collected and stored in the collection unit 9.

At this time, the fine copper particles P having a desired particle diameter distribution, for example, the average particle diameter is 500 nm or less can be produced as a product by further classifying the fine copper particles P caught in the bug filter 8 using a classifying device not shown in figures. At this time, the remaining fine copper particles after classification (mainly fine copper particles having a large particle diameter) can be recovered and reused as a powder raw material.

In the present embodiment, an embodiment is described in which the combustible gas G1 and the powder raw material M are introduced into the burner 3 using the combustible gas G1 as a carrier gas. However, the present invention is not limited to this embodiment. For example, the powder raw material M may be directly blown into the reducing flame formed by the burner from a portion other than the burner. Alternatively, the powder raw material M may be separately transferred to the burner using a gas other than a fuel (for example, air) as a carrier gas.

Moreover, as the fuel for forming the reducing flame, hydrocarbon fuel oil, and the like can also be used other than the combustible gas, for example. In this case, it is desirable that the powder raw material M be directly blown into the reducing flame from a portion other than the burner.

<Method for Producing Sintered Body>

The production method for a sintered body of this embodiment is a method for producing a sintered body using the fine copper particles of the present embodiment as a raw material, and sintering them in a reducing atmosphere at 150° C. or less.

Here, as described in the present embodiment, "sintering in a reducing atmosphere of 150° C. or lower" means that the fine copper particles P are sufficiently sintered in a reducing atmosphere of 150° C. or lower within one hour as described above.

Specifically, first, for example, an organic solvent is added to the fine copper particles P produced by the production method so that the weight ratio of the fine copper particles P becomes a predetermined ratio, and stirring is performed at a rotational speed of about 2000 rpm for a predetermined time.

Next, the mixture which has become a paste by stirring is applied to, for example, a glass substrate.

Then, for example, the glass substrate coated with the mixture is sintered at a temperature of 150° C. or lower for 1 hour in a reducing atmosphere of nitrogen gas to which hydrogen gas is added in a predetermined amount, and thereby a sintered body can be produced.

Further, the sintered state of the sintered body can be determined by measuring the volume resistivity of the sintered body. The volume resistivity can be measured by a four-terminal method using a commercially available volume resistivity meter (for example, Lorester GP MCP-T610 manufactured by Mitsubishi Chemical Analytech Co., Ltd.) or the like.

In general, when fine copper particles exhibit low resistivity with a volume resistivity of $1.0\times10^{-6}$ Ω·m or less, it can be judged that the cuprous oxide on the surface of the fine copper particles is reduced and combusted sufficiently well.

Figure 5:
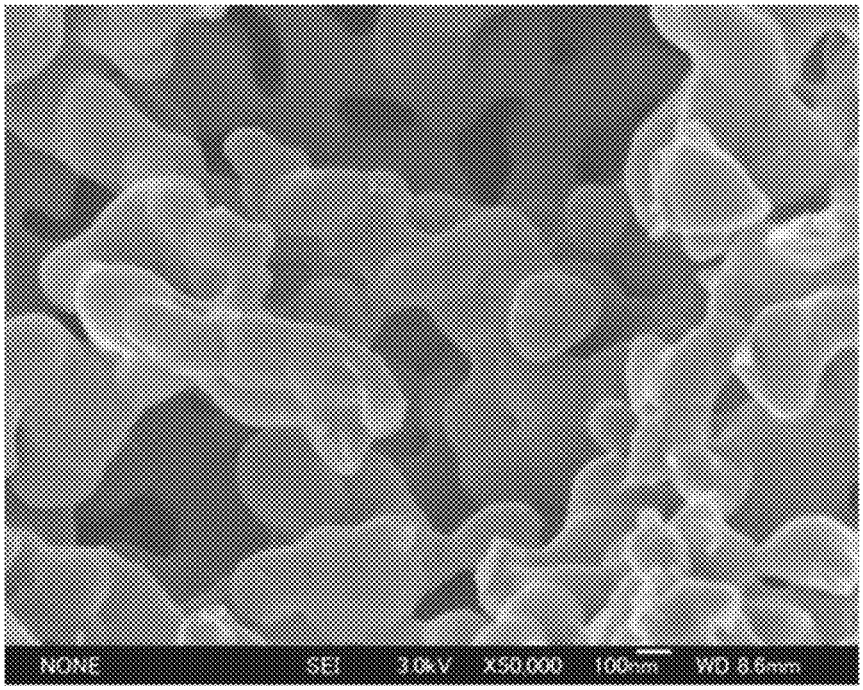
FIG. 5 is a figure for explaining the method for producing a sintered body which is one embodiment of the present invention, and is the photograph of a sintered body produced by sintering the fine copper particles by a scanning electron microscope (SEM).

As shown in an observation photograph by a scanning electron microscope (SEM) in FIG. 5, the sintered body of this embodiment is produced by sintering the fine copper particles P having the configuration above. As described above, the fine copper particles P have the coating film containing cuprous oxide and having a thickness of 1.5 nm or less on the entire surface. The production method for a sintered body of the present embodiment is a method of sintering the fine copper particles P described above as a raw material. For this reason, even at a sintering temperature as low as 150° C., the coating film is easily reduced during sintering, and a sintered body can be produced with excellent sinterability.

The method for producing a sintered body of this embodiment can be used in the formation of high-density wirings and the like on the surface of a resin substrate having low heat resistance, for example, because the sintering temperature is suppressed to 150° C. As described above, when the production method for a sintered body of the present embodiment is used in the formation of high-density wiring or the like on a resin substrate, it is possible to further reduce the cost of electronic devices, printed wiring boards, and the like.

<Effects>

As described above, the fine copper particles P of the present embodiment are entirely covered with the coating film containing cuprous oxide and having an average film thickness of 1.5 nm or less. For this reason, even when the fine copper particles P of the present embodiment are stored in the atmosphere, it is possible to effectively suppress the deterioration due to oxidation. Further, when the fine copper particles P are sintered, the coating film containing cuprous oxide is easily reduced, so that the sintering temperature can be lowered.

Therefore, for example, since the fine copper particles P can be used in high-density wiring on the surface of a resin substrate having low heat resistance, it is possible to reduce the cost of electronic devices, printed wiring boards, and the like.

Further, according to the production method for fine copper particles of the present embodiment, the coating film containing cuprous oxide can be formed on the entire surface of the fine copper particles P while suppressing the thickness of the coating film containing cuprous oxide to 1.5 nm or less by adjusting the mixing ratio between the combustible gas G1 and the combustion supporting gas G2 which are supplied to the burner 3. For this reason, the oxidation of the fine copper particles P is prevented from proceeding in the atmosphere, and is difficult to deteriorate. Moreover, it is possible to produce fine copper particles P having a sintering temperature lower than that of the prior art by producing fine copper particles P so that the coating film containing cuprous oxide has the average film thickness.

Further, the production method for a sintered body of the present embodiment is a method in which the fine copper particles P of the present embodiment having a low sintering temperature as described above are used as a raw material and sintered them in a reducing atmosphere of 150° C. or lower. Therefore, the production method for a sintered body can be easily used in, for example, high-density wiring on the surface of a resin substrate having low heat resistance, and it is possible to reduce the cost of electronic devices, printed wiring boards, and the like.

EXAMPLES

The fine copper particles, the production method for fine copper particles, and the production method for a sintered body according to the present invention will be described in more detail with reference to examples. However, the present invention is not limited to the following examples.

Example 1

In Example 1, fine copper particles P were produced by the procedure explained below using a producing apparatus 50 as shown in FIG. 2 (including the burner 3 shown in FIGS. 3 and 4) under conditions shown in Tables 1 and 2 below (see also Example 1 in Table 3).

In Example 1, 100% methane gas as shown in Table 1 below was used as the combustible gas G1 supplied from the combustible gas supply unit 1 to the burner 3 through the feeder 2, and the flow rate was adjusted to 2.35 $Nm^3/h$.

Moreover, 100% oxygen gas was used as the combustion supporting gas G2 supplied from the combustion supporting gas supply unit 4, the flow rate was adjusted to 2.82 $Nm^3/h$, and the oxygen ratio was adjusted to 0.60.

In Example 1, the mixing ratio between the combustible gas G1 and the combustion supporting gas G2 was adjusted so that the volume ratio of $CO/CO_2$ in the combustion exhaust gas G3 generated by the combustion of the burner 3 was 1.78.

In Example 1, copper (I) oxide powder having an average particle diameter of 10 μm was used as the powder raw material M which was the raw material. The powder raw material M was quantitatively transferred from the feeder 2 at a flow rate of 0.72 kg/h using the combustible gas G1 as a carrier gas.

In Example 1, the copper (I) oxide powder transferred by the combustible gas G1 into the reaction furnace 6 is evaporated in a high-temperature reducing flame formed by the burner 3, and fine copper particles P of submicron or less were produced. Thereafter, the fine copper particles P contained in the exhaust gas D from the water cooling path were caught by the bug filter 8 and collected by the collection unit 9.

Then, it was confirmed that the coating film containing cuprous oxide was formed on the surface of the fine copper particles P produced by analyzing the fine copper particles P produced in Example 1 by X-ray photoelectron spectroscopy (XPS).

Further, the specific surface area of the fine copper particles P produced was measured using a commercially available specific surface area meter (manufactured by Mountech Co., Ltd.: Macsorb HM model-1201), and the particle diameter was determined by conversion from the specific surface area. The results were shown in Tables 2 and 3 below.

Further, the mass oxygen concentration of the fine copper particles produced P was measured with an oxygen/nitrogen analyzer (manufactured by LECO: TC-600 type). From the mass oxygen concentration and the average particle diameter of the fine copper particles P, the thickness of the coating film containing cuprous oxide formed on the surface was calculated. The results were shown in Tables 2 and 3 below.

The observation photograph by the scanning electron microscope (SEM) of the fine copper particles produced in Example 1 was shown in FIG. 1.

From FIG. 1, it could be understood that the fine copper particles produced in Example 1 were fine particles having a good shape without fusing each of the fine copper particles.

Furthermore, the fine copper particles P produced in Example 1 were left in the atmosphere at a temperature of 25° C. and a humidity of 65%, and the relationship between the standing time and the increase in oxygen concentration in the fine copper particles P was examined. The results were shown in the graph of FIG. 6. At this time, the oxygen concentration was measured with the oxygen/nitrogen analyzer (manufactured by LECO: TC-600 type) in the same manner as described above, and the increase in oxygen concentration with the passage of the standing time was examined.

Next, 2-propanol was added to the fine copper particles P produced in Example 1 so that the weight ratio of the fine copper particles was 63% by mass, and the mixture was stirred by a commercially available kneader (Shinky Corporation: Awatori Neritaro (Registered trademark)) under the conditions of a rotation speed of 2,000 rpm and a rotation time of 1 min to produce a paste.

Next, the paste produced was applied to a glass substrate, and the glass substrate with the paste was sintered at a constant temperature of 150° C. for 1 hour in a reducing atmosphere in which 3% by volume of hydrogen gas was added to nitrogen gas. The volume resistivity of the sintered body produced was measured by a four-terminal method, and the volume resistivity is shown in Table 3 below as an index of the sinterability (sintering temperature) of the fine copper particles. As described above, it could be judged that when the fine copper particles had a low resistivity of volume resistivity of $1.0\times10^{-6}$ Ω·m or less, the cuprous oxide on the surface of the fine copper particles was reduced and sintered sufficiently well.

The SEM photograph of the sintered body after sintering the fine copper particles P produced in Example 1 was shown in FIG. 5.

From FIG. 5, it could be understood that the sintered body produced by sintering the fine copper particles produced in Example 1 was in a state in which each of the fine copper particles is satisfactorily sintered.

Table 1 below shows the production conditions of the fine copper particles P in Example 1, that is, each condition of the combustible gas G1, the combustion supporting gas G2, the oxygen ratio, and the volume ratio of $CO/CO_2$ in the combustion exhaust gas G3. Table 2 below shows the average particle diameter of the fine copper particles P produced in Example 1 and the average film thickness of the coating film formed on the surface. Table 3 below shows a list of the average particle diameter of the fine copper particles P and the average film thickness of the coating film, and the volume resistivity of the sintered body produced by sintering the fine copper particles P.

TABLE 1

| | Conditions for producing fine copper particles | | | | |
|---|---|---|---|---|---|
| | Kind of Combustible gas | Flow rate of combustible gas [$Nm^3/h$] | Flow rate of combustion supporting gas [$Nm^3/h$] | Oxygen ratio [—] | Volume ratio of CO/CO□ in combustion exhaust gas [—] |
| Example 1 | 100% Methane gas | 2.35 | 2.82 | 0.6 | 1.78 |

TABLE 2

| | Properties of fine copper particles | |
|---|---|---|
| | Average particle diameter [nm] | Average film thickness of coating film containing cuprous oxide formed on the surface [nm] |
| Example 1 | 125 | 1.3 |

TABLE 3

| | Conditions for producing fine copper particles | | Properties of fine copper particles | | |
|---|---|---|---|---|---|
| Examples or Comparative Examples | Kind of Combustible gas | Volume ratio of CO/CO□ in combustion exhaust gas [—] | Average particle diameter [nm] | Average film thickness of coating film formed on the surface [nm] | Properties of sintered body Volume resistivity [Ω · m] |
| Example 1 | 100% Methane gas | 1.78 | 125 | 1.3 | $6.70 \times 10^{-7}$ |
| Comparative Example 1 | | 0.5 | 118 | 4 | $7.03 \times 10^{-4}$ |
| Comparative Example 2 | | 0.86 | 121 | 4.2 | $6.21 \times 10^{-4}$ |
| Comparative Example 3 | | 1.1 | 123 | 4 | $5.17 \times 10^{-4}$ |
| Comparative Example 4 | | 1.33 | 124 | 3.2 | $9.65 \times 10^{-5}$ |
| Example 2 | | 2.04 | 129 | 1.4 | $5.69 \times 10^{-7}$ |
| Example 3 | | 2.38 | 127 | 1.2 | $6.14 \times 10^{-7}$ |
| Comparative Example 5 | | 2.54 | 128 | 1.2 | Impossible to produce |
| Comparative Example 6 | 80% Methane gas + 20% Hydrogen gas | 1.23 | 123 | 4.4 | $5.28 \times 10^{-4}$ |
| Comparative Example 7 | | 1.46 | 121 | 4.2 | $6.31 \times 10^{-4}$ |
| Example 4 | | 2.07 | 126 | 1.2 | $6.25 \times 10^{-7}$ |
| Example 5 | 60% Methane gas + 40% Hydrogen gas | 2.35 | 124 | 1 | $5.79 \times 10^{-7}$ |
| Comparative Example 8 | | 2.78 | 125 | 1.3 | Impossible to produce |
| Comparative Example 9 | 100% Propane gas | 0.75 | 114 | 3.8 | $8.17 \times 10^{-4}$ |
| Comparative Example 10 | | 1.06 | 116 | 3 | $4.05 \times 10^{-5}$ |

TABLE 3-continued

| Examples or Comparative Examples | Conditions for producing fine copper particles: Kind of Combustible gas | Volume ratio of CO/CO□ in combustion exhaust gas [—] | Properties of fine copper particles: Average particle diameter [nm] | Average film thickness of coating film formed on the surface [nm] | Properties of sintered body Volume resistivity [Ω · m] |
|---|---|---|---|---|---|
| Comparative Example 11 | | 1.31 | 125 | 1.9 | $2.18 \times 10^{-5}$ |
| Example 6 | | 1.53 | 124 | 1.1 | $6.14 \times 10^{-7}$ |
| Example 7 | | 1.75 | 127 | 1.2 | $5.32 \times 10^{-7}$ |

Examples 2 to 7, and Comparative Examples 1 to 11

In Examples 2 to 7 and Comparative Examples 1 to 11, fine copper particles P were produced and evaluated under the same conditions and procedures as in Example 1, except that the combustible gas shown in Table 3 was used, and the volume ratio of $CO/CO_2$ in the combustion exhaust gas G3 was adjusted shown in Table 3. The results were shown in Table 3.

Specifically, in Examples 2 to 7 and Comparative Examples 1 to 11, any one of 100% methane gas, 80% methane gas+20% hydrogen gas, 60% methane gas+40% hydrogen gas, and 100% propane gas was used as the combustible gas G1. The volume ratio of $CO/CO_2$ in the combustion exhaust gas G3 was adjusted to satisfy the conditions shown in Table 3 by changing the flow rate of the combustion supporting gas G2 while maintaining the flow rate of the combustible gas G1 constant.

In Examples 2 to 7 and Comparative Examples 1 to 11, a sintered body was also produced by sintering the fine copper particles P produced and evaluated under the same conditions and procedures as in Example 1. The results were shown in Table 3.

<Evaluation Results>

As shown in Tables 1 to 3, the volume resistivity of the sintered body produced by sintering the fine copper particles P of Example 1 having the structure according to the present invention, and produced by the production method according to the present invention at 150° C. was $6.70\times10^{-7}$ Ω·m. The volume resistivity exhibited that the fine copper particles P of Example 1 had a low resistivity significantly lower than a volume resistivity of $1.0\times10^{-6}$ Ω·m, which is an index of sinterability when fine copper particles were sintered. Thereby, it was confirmed that the fine copper particles P of Example 1 had a sintering temperature as low as 150° C. or lower and were extremely excellent in sinterability.

Figure 6:
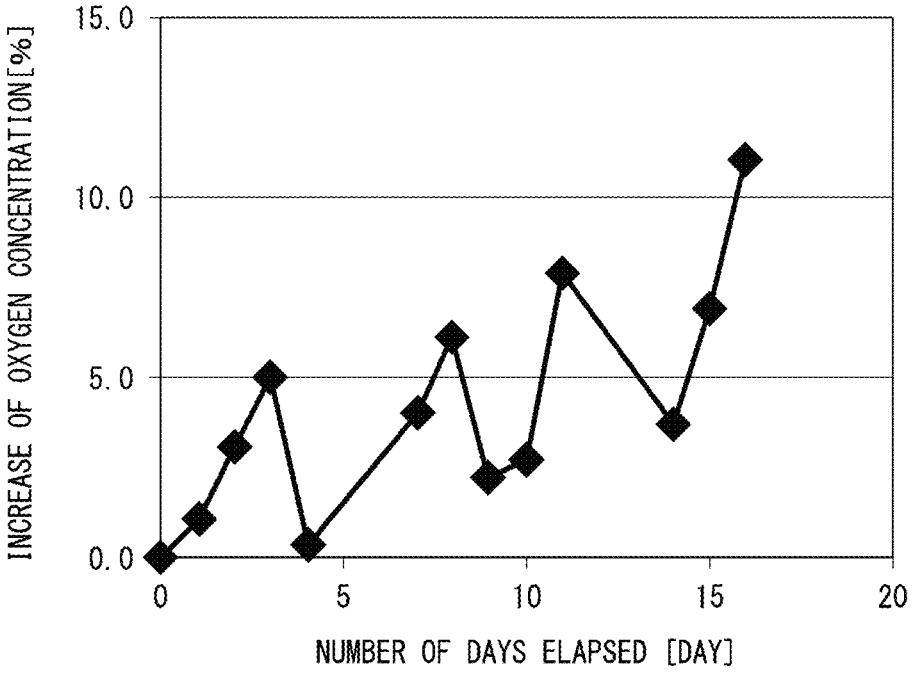
FIG. 6 is a figure for explaining the fine copper particles according to one embodiment of the present invention, and is a graph showing an amount of increase in an oxygen concentration in the fine copper particles when the fine copper particles produced in Examples were left in the atmosphere.

Further, as shown in the graph of FIG. 6, the fine copper particles P of Example 1 had an oxygen concentration increase amount of less than 10% after being left in the atmosphere for 15 days after production. In general, when the surface of fine copper particles is not completely covered with the coating film containing cuprous oxide, the oxygen concentration increase will exceed 10% in about 2 hours and cannot be used as a material for a sintered body. It was confirmed that the fine copper particles P of Example 1 were sufficiently stable even when left in the atmosphere, that the coating film containing cuprous oxide covered the entire surface of the fine copper particles.

Further, as shown in Table 3, the volume resistivity of the sintered body produced by sintering the fine copper particles P of all Examples 2 to 7 having the structure according to the present invention, and produced by the production method according to the present invention at 150° C. was significantly below $1.0\times10^{-6}$ Ω·m. As a result, it was confirmed that the fine copper particles P of Examples 2 to 7 had a sintering temperature as low as 150° C. or lower as in Example 1, and were extremely excellent in sinterability.

On the other hand, as shown in Table 3, the volume ratio of $CO/CO_2$ in the combustion exhaust gas G3 during the production in the fine copper particles of Comparative Examples 1 to 11 was outside the specified range of the present invention. Further, the average film thickness of the coating film on the surface of the fine copper particles produced was outside the specified range of the present invention.

Among these Comparative Examples, Comparative Examples 1 to 4, 6, 7, and 9 to 11 had a volume ratio of $CO/CO_2$ in the combustion exhaust gas G3 of less than 1.5, which was below the lower limit defined in the present invention. Further, the average thickness of the coating film on the surface of the fine copper particles produced was 1.9 to 4.4 nm, which exceeded the upper limit defined in the present invention.

As shown in Table 3, the volume resistivity of the sintered body produced by sintering the fine copper particles of Comparative Examples 1 to 4, 6, 7, and 9 to 11 exceeded $1.0\times10^{-6}$ Ω·m. It could be judged that when fine copper particles of Comparative Examples 1 to 4, 6, 7, and 9 to 11 were used as a raw material and sintering was performed at 150° C. for 1 hour, the cuprous oxide on the surface of the fine copper particles could not be reduced and the sintering was not sufficient.

In Comparative Examples 5 and 8 in which the volume ratio of $CO/CO_2$ in the combustion exhaust gas G3 exceeds 2.5, it was confirmed that the coating film having a predetermined average film thickness was formed on the surface of the fine copper particles. However, the fine copper particles to which 2-propanol was added did not become paste, and it was impossible to produce a sintered body. This is presumably because in Comparative Examples 5 and 8, the organic matter that becomes an impurity was generated due to the too high ratio of CO in the combustion exhaust gas G3, and the fine copper particles became difficult to be dispersed in 2-propanol.

Figure 7:
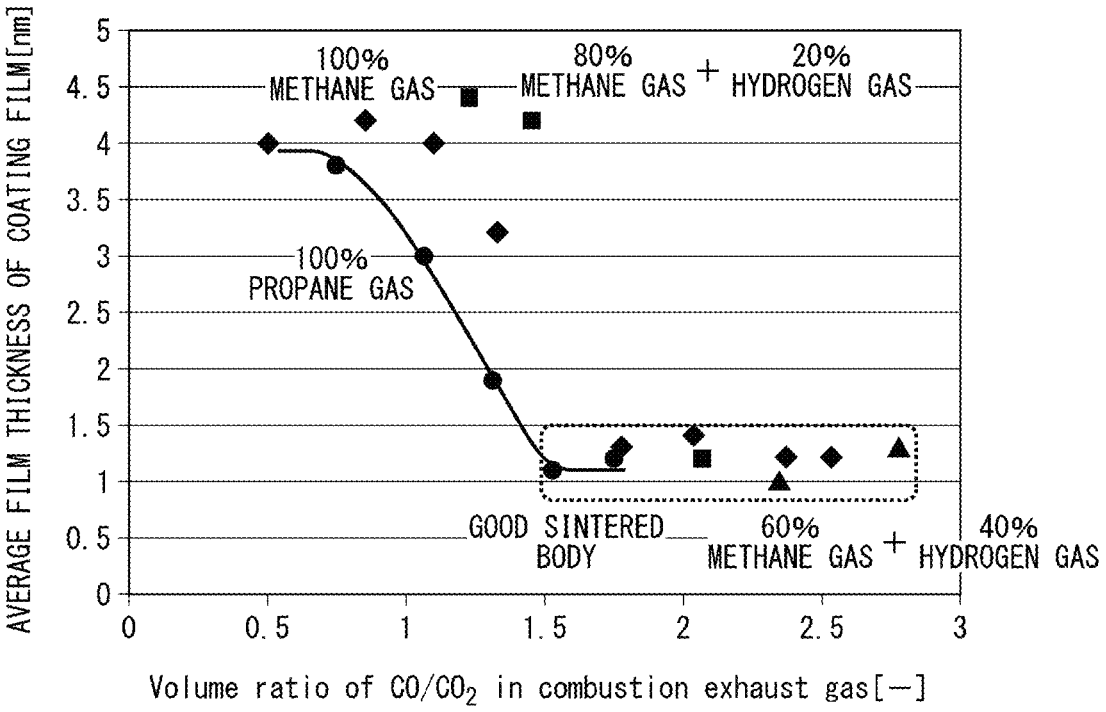
FIG. 7 is a figure for explaining the fine copper particles and the production method thereof according to an embodiment of the present invention, and is a graph showing a relationship between a volume ratio of $CO/CO_2$ in a combustion exhaust gas of the burner and the average film thickness of the coating film containing cuprous oxide formed on the surface of the fine copper particles.

A graph in which the volume ratio of $CO/CO_2$ in the combustion exhaust gas G3 and the average film thickness of the coating film containing cuprous oxide formed on the surface of the fine copper particles in each Example shown in Table 3 were plotted, was shown in FIG. 7.

From FIG. 7, it was confirmed that even when the kind of the gas of the combustible gas G1 was changed, it was possible to control the thickness of the coating film formed on the surface of the fine copper particles by adjusting the volume ratio of $CO/CO_2$ in the combustion exhaust gas G3 to be within the range defined in the present invention.

Further, from the data shown in Table 3, it could be understood that the production condition of the fine copper particles P capable of producing a sintered body which had a volume resistivity of less than $1.0\times10^{-6}$ Ω·m and was determined that the sintered state was sufficiently good was that the volume ratio of $CO/CO_2$ in the combustion exhaust gas G3 was in the range of 1.5 to 2.4. In addition, it could be also understood that the production condition which can reduce the average film thickness of the coating film on the surface of the fine copper particles P to 1.5 nm or less was that the volume ratio of $CO/CO_2$ in the combustion exhaust gas G3 was in the range above.

In general, the higher the average film thickness of the coating film containing cuprous oxide on the surface of the fine copper particles, the higher the sintering temperature is required to remove the coating film. That is, when the coating film on the surface of the fine copper particles is too thick, it cannot be sufficiently sintered at a temperature of 150° C., and the volume resistivity of the sintered body becomes a high value. On the other hand, it was confirmed that the fine copper particles P which had excellent sintering properties and could be sufficiently sintered at a temperature of 150° C. could be produced by producing the fine copper particles P under conditions in which the volume ratio of $CO/CO_2$ in the combustion exhaust gas G3 was in the range of 1.5 to 2.4 and controlling the average film thickness of the coating film containing cuprous oxide formed on the surface to 1.5 nm or less as in Examples 1 to 7.

INDUSTRIAL APPLICABILITY

The fine copper particles of the present invention can be easily used in, for example, high-density wiring on the surface of a resin substrate having low heat resistance, and is very suitable for electronic devices, printed wiring boards, and the like.

EXPLANATION OF REFERENCE NUMERAL

1 combustible gas supply unit
2 feeder
3 burner
31 raw material ejection passage
32 primary combustion supporting gas ejection passage
33 secondary combustion supporting gas ejection passage
34 water-cooled jacket
4 combustion supporting gas supply unit
6 reaction furnace
8 bug filter
9 collection unit
10 blower
50 producing apparatus (producing apparatus of fine copper particles)
G1 combustible gas
G2 combustion supporting gas
G3 combustion exhaust gas
M powder raw material (copper or copper compound)
P fine copper particles
D exhaust gas (gas containing fine copper particles and fuel exhaust gas)

The invention claimed is:

1. A method for producing fine copper particles in which the fine copper particles having a coating film containing cuprous oxide on a surface of the fine copper particles are produced by heating copper or a copper compound in a reducing flame formed by a burner, wherein the fine copper particles are produced by adjusting a mixing ratio between a combustible gas and a combustion supporting gas which form the reducing flame such that a volume ratio of $CO/CO_2$ is in a range of 1.5 to 2.4.

2. A method for producing a sintered body comprising the steps of:

producing fine copper particles in a reducing flame formed by a burner by adjusting a mixing ratio between a combustible gas and a combustion supporting gas which form the reducing flame such that a volume ratio of $CO/CO_2$ is in a range of 1.5 to 2.4; and sintering the fine copper particles in a reducing atmosphere at 150° C. or lower.

* * * * *